US005904266A

United States Patent [19]

Tedeschi, Jr.

[11] Patent Number: 5,904,266

[45] Date of Patent: May 18, 1999

[54] PRODUCT PACKAGE AND STACKABLE LID ASSEMBLY THEREFOR

[75] Inventor: Thomas Tedeschi, Jr., Brewster, N.Y.

[73] Assignee: Kraft Foods Inc., Northfield, Ill.

[21] Appl. No.: 08/954,835

[22] Filed: Oct. 21, 1997

[51] Int. Cl.[6] ..... B65D 51/28

[52] U.S. Cl. ..... 220/521; 220/781; 215/230; 215/246; 215/228; 215/227; 206/459.5; 426/120

[58] Field of Search ..... 215/230, 227, 215/228, 246, 317, 321, 6; 220/521, 522, 254, 256, 257, 305, 780, 781, 792, 376, 377, 380; 206/509, 457, 459.5, 216, 217; 426/119, 120, 112

[56] References Cited

U.S. PATENT DOCUMENTS

| | | | |
|---|---|---|---|
| 2,015,028 | 9/1935 | Gillette . | |
| 3,070,275 | 12/1962 | Bostrom | 220/521 X |
| 3,421,653 | 1/1969 | Whaley . | |
| 3,768,688 | 10/1973 | Linke . | |
| 3,880,288 | 4/1975 | Hunter | 220/781 X |
| 4,389,802 | 6/1983 | McLaren et al. . | |
| 4,407,426 | 10/1983 | McLaren et al. . | |
| 4,782,976 | 11/1988 | Kenyon, 2nd. | 215/246 X |
| 4,872,586 | 10/1989 | Landis | 220/781 |
| 5,246,133 | 9/1993 | James | 220/377 |
| 5,592,766 | 1/1997 | MyGatt . | |
| 5,722,558 | 3/1998 | Thompson | 220/521 |
| 5,725,122 | 3/1998 | Murphy et al. | 220/521 |
| 5,769,263 | 6/1998 | Willingham et al. | 215/228 X |

FOREIGN PATENT DOCUMENTS

| | | | |
|---|---|---|---|
| 2930361 | 2/1980 | Germany | 220/521 |

*Primary Examiner*—Stephen K. Cronin
*Assistant Examiner*—Nathan Newhouse
*Attorney, Agent, or Firm*—Thomas R. Savoie; Thomas A. Marcoux

[57] ABSTRACT

A product package includes a vertical container in which a base product is located and a lid assembly. The container has a top opening and a side periphery while the lid assembly include a lid which closes the top opening of the container. The lid includes (a) a peripheral skirt which engages the side periphery to hold the lid in place, (b) a top extending centrally of the peripheral skirt and having a top band extending centrally from adjacent the upper end of the peripheral skirt and a depression which extends downwards from the top band to a position substantially equal to or above the lower edge of the skirt, and (c) a peripheral retention lip which extends upwards and inwards from the top band. The lid assembly also includes an insert having a peripheral border. The insert is sized such that the peripheral border is retained underneath of the peripheral retention lip so that the insert is held on the lid. The lid assembly also includes a secondary product which is located in the depression and which is held therein by the insert. Preferably, the product package also includes a tamper evident shrink band.

9 Claims, 2 Drawing Sheets

PRODUCT PACKAGE AND STACKABLE LID ASSEMBLY THEREFOR

FIELD OF THE INVENTION

The present invention relates generally to product packages and lid assembly therefor, and more particularly to a product package and lid member in which a secondary item is retained on the lid member to accompany the product package.

BACKGROUND OF THE INVENTION

When providing a base product in a package, it is sometimes desirable to provide a secondary item with the base product contained in a container. While applying the secondary item to the lid is one means of providing the secondary item in a handy manner, such an application often results in pilferage or other loss of the secondary item prior to purchase by the consumer. In addition, applying of the secondary item to the lid may ruin the stackability of the packages being displayed to the consumer. Further, while it is often advantageous to apply the secondary item prior to application of the lid to the container, such an lid with a secondary item attached thereto may then no longer be stackable making subsequent automatic application of the lid to the container difficult.

SUMMARY OF THE INVENTION

In accordance with the present invention, a product package and lid assembly therefor are provided to overcome the problems of the prior art noted above. In particular, the product package includes a generally-circular container in which a base product is located and a lid assembly. The container has a top opening and a side periphery adjacent the top opening. The lid member includes a lid which closes the top opening of the container. The lid includes (a) a peripheral skirt which engages the side periphery of the container to hold the lid in place on the container, the skirt having a lower edge and an upper end, (b) a top extending centrally of the peripheral skirt, the top having a top band extending centrally from adjacent the upper end of the peripheral skirt and a depression which extends downwards from the top band to a position above the lower edge of the skirt, and (c) a peripheral retention lip which extends upwards and inwards from the top band. The lid member also includes an insert having a peripheral border. The insert is sized such that the peripheral border is retained underneath of the peripheral retention lip so that the insert is held on the lid. The lid assembly also includes a secondary product which is located in the depression and which is held therein by the insert.

Preferably, the product package also includes a tamper evident shrink band. The shrink band engages the side periphery of the container, the peripheral skirt, the retention lip, and a portion of the top band for retaining the lid on the container and the insert on the lid. The presence of the shrink band also helps to reduce pilferage of the secondary product since the insert cannot be easily removed.

In the preferred embodiment, the side periphery of the container and the peripheral skirt are slightly conical (appearing cylindrical), the insert is flat, the retention lip is an inwardly-angled circular ring, the top band is circular and has an inner flat portion, and the depression is centrally located relative to the peripheral skirt. In addition, the insert is made of paperboard and has a wavy edge, the base product is a food item, and the secondary product is complementary to the food item. Further in the preferred embodiment, the lid is a molded plastics material, the peripheral skirt includes an interior groove thereabout, and the side periphery of the container includes an upper exterior ledge thereabout which is retained in the groove of the peripheral skirt when the lid is positioned to close the top opening of the container.

One preferred insert includes an aperture located over the depression, and a transparent sheet attached to the insert which covers the aperture and hence which allows the secondary product in the depression to be viewed therethrough. Other embodiments of the insert include an insert with two apertures located over the depression through which the (or a respective) secondary product is viewable, and an insert which is a solid piece.

It is an object of the present invention to allow for the delivery of a secondary product with a product package including a base product.

It is also an object of the present invention to provide a secondary product which is not easily pilfered.

It is a further object of the present invention to facilitate production of a product package having a secondary product by allowing the secondary product to be pre-applied to the lid of the package.

It is another object of the present invention to provide a lid assembly with a secondary product with the lid member remaining stackable in the filling equipment magazines.

Still another object of the present invention is to provide a secondary product in a product package without changing the outside dimensions of the product package so that no dimension change is made in the product package when the secondary product is provided compared to when the secondary product is not provided.

Other features, advantages and objects of the present invention are stated in or apparent from the detailed description of presently preferred embodiments of the invention found hereinbelow.

DESCRIPTION OF THE PREFERRED EMBODIMENTS

Figure 1:
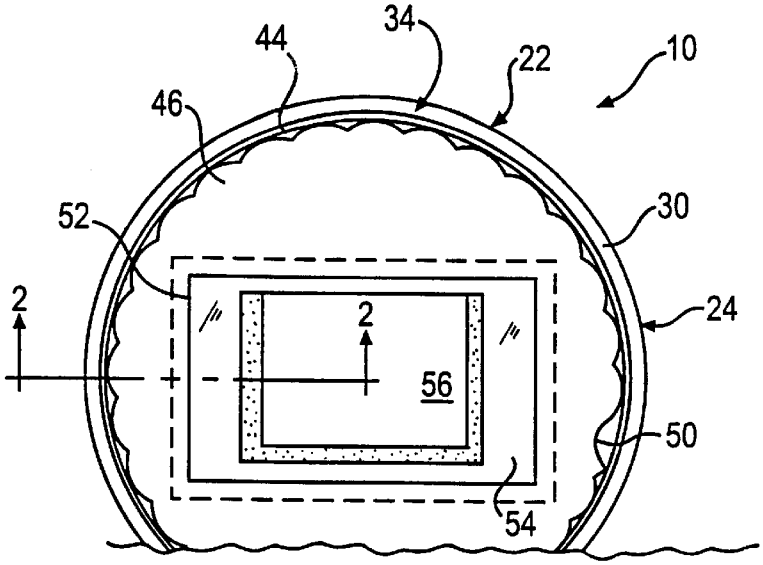
FIG. 1 is a top plan view of a product package according to the present invention.
Figure 2:
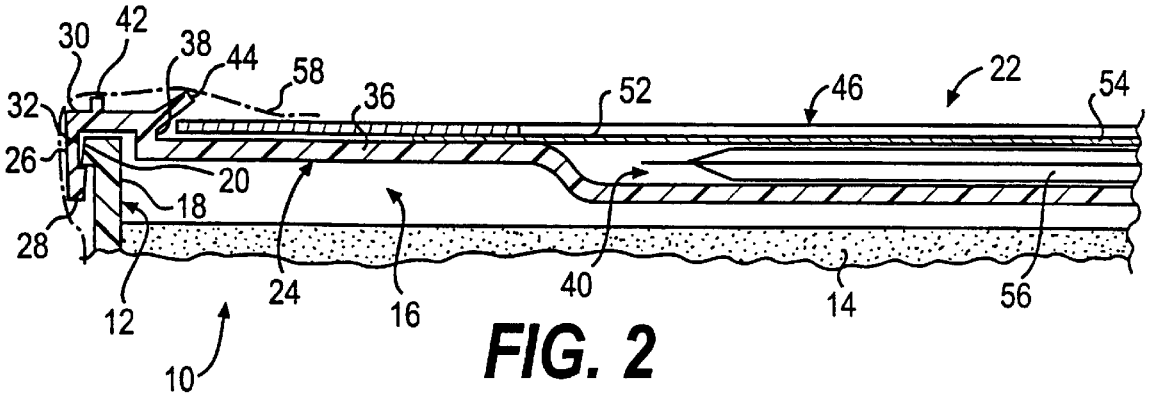
FIG. 2 is a cross-sectional elevation view of the product package depicted in FIG. 1 taken along the section line 2—2 in FIG. 1.

With reference now to the drawings in which like numerals represent like elements throughout the views, a product package 10 is depicted in FIGS. 1–2. Product package 10 broadly includes a container 12, of which only a portion is shown for convenience as such containers (typically cylindrical or truncated conical) are well known in the art. Provided in container 12 is a base product 14, such as a food item or product like frozen whipped topping or frosting. Container 12 has a top opening 16 through which base product 14 is removed and a side periphery 18 adjacent to top opening 16. Side periphery 18 is slightly conical shaped (upwards and outwards, though it appears essentially cylindrical) and includes an upper exterior ledge 20 at the top thereof.

Product package 10 also includes a lid assembly 22. Lid assembly 22 includes a lid 24 which is formed of a molded plastics material by injection molding or thermoforming so as to be bendable and hence easily applied to top opening 16 of container 12 to close top opening 16 (as well known in the art). Lid 24 is formed to have a peripheral skirt 26 which is slightly conical (inclined downwardly and inwardly, though it appears essentially cylindrical as shown), and is comprised of a lower edge 28, an upper end 30, and an interior groove 32 provided between lower edge 28 and upper end 30. As shown in FIG. 2, lid 24 is retained on container 12 to close top opening 16 by engagement of ledge 20 in interior groove 32.

Lid 24 also includes a top 34 extending centrally from peripheral skirt 26. In prior art lids well-known and typically used in the art, the top has a small step adjacent the upper end in which the ledge of the container is retained, but otherwise the top is flat. However, with the present invention, top 34 has a top band 36 extending centrally from upper end 30 of peripheral skirt 26. Top band 36 includes a small step 38 in order to catch the top edge of container 12 including ledge 20 between step 38 and interior groove 32. From step 38, top band 36 is flat and terminates where a central and generally flat depression 40 is provided in top 34. Depression 40 extends downwards from top band 36 to a lowermost position which is substantially equal to or above the position of lower edge 28 of skirt 26. It will thus be appreciated that, in the same manner that prior art lids having completely flat tops are random orientation stackable, lids 24 of the present invention are likewise random orientation stackable. Depression 40 could extend slightly below lower edge 28 of skirt 26 to the extent that the top surface of insert 46 resides below the top surface of top band 36.

Figure 3:
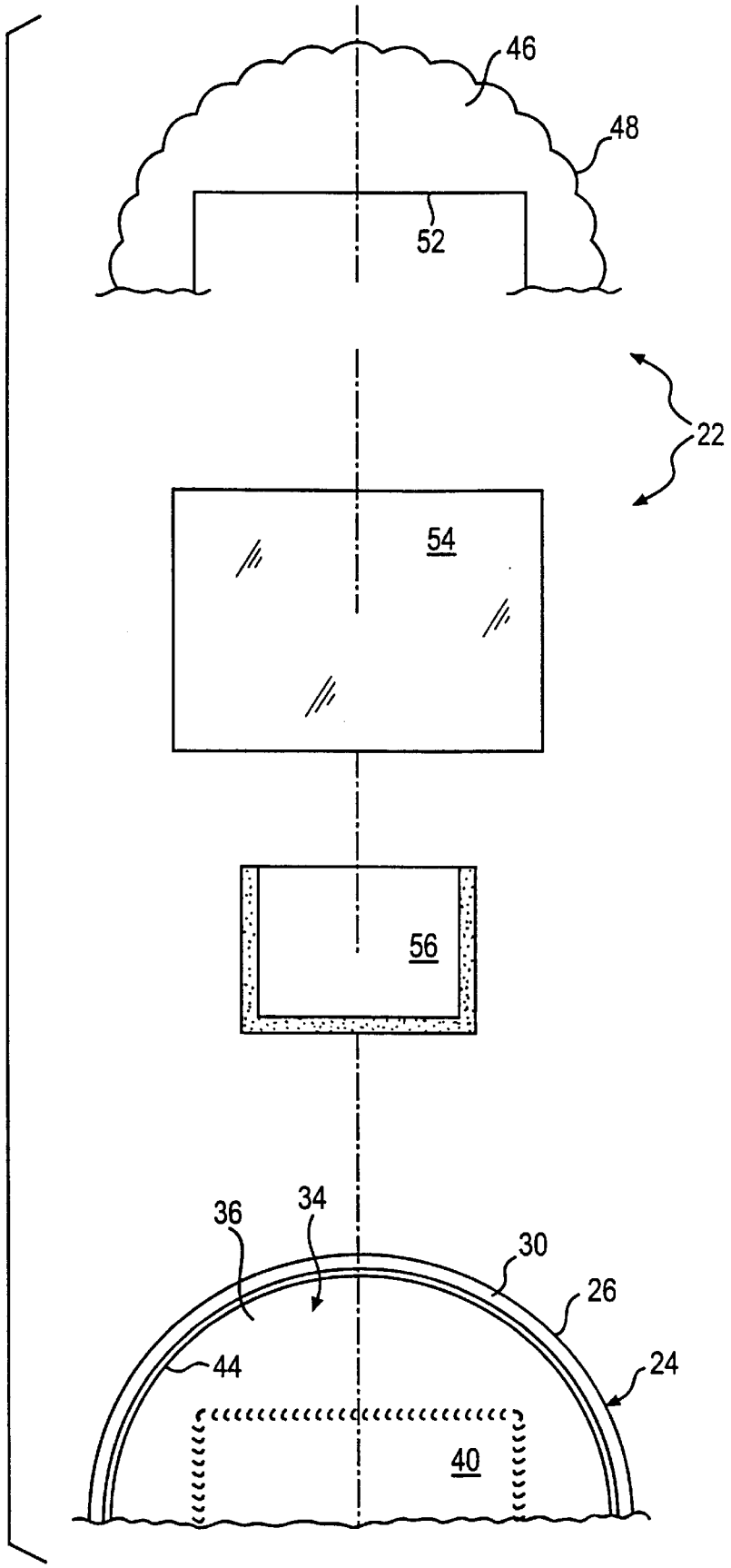
FIG. 3 is an exploded top plan view of the individual elements of the lid assembly of FIG. 1, with only half of some symmetrical elements shown.

To facilitate stacking of the lids, top 34 of lid 24 further includes a small indexing rib 42 adjacent skirt 26 which thereby fits inside lower edge 28 of a lid 24 placed thereabove (and which is depicted in FIG. 2 but omitted from FIGS. 1 and 3 for clarity).

Finally, lid 24 includes a retention lip 44, formed as an inwardly and upwardly angled circular ring as shown. Lip 44 is preferably located where step 38 begins, but lip 44 could be located along top band 36 at any position inward from step 38 (as will appreciated from the subsequent discussion).

Lid assembly 22 also includes an insert or label 46. Insert 46 is preferably formed of paperboard with suitable indicia thereon to identify base product 14 or provide other label information for base product 14. Insert 46 includes a peripheral border formed with a wavy edge 48 as shown. The size of insert 46, and in particular the span of wavy edge 48, is chosen so that insert 46 is removably held on lid 24 with wavy edge 48 thereof retained underneath of retaining lip 44 as shown best in FIG. 2. Thus, the diameters of retention lip 44 and insert 46 are chosen to provide this holding feature, and the radial position of retention lip 44 must only be at or inside of step 38 so that insert 46 lays flat and does not ride over step 38. For ease of removal of insert 46 from underneath retention lip 44 by the consumer, wavy edge 48 also includes a small cutout 50. Preferably, as shown in FIGS. 1 and 3, insert 46 includes an aperture 52 located above depression 40 and a transparent sheet 54 adhered or otherwise attached to an inside surface of insert 46 so that sheet 54 covers aperture 52.

Finally, lid assembly 22 includes a generally flat secondary product 56 which is located in depression 40 and which is held there by insert 46. Secondary product is sufficiently thin so that it does not extend substantially above the surrounding portions of top band 36 as shown. Conveniently, secondary product 56 is simply formed by folding a rectangular sheet onto itself with a secondary material therebetween and adhering the free and overlapping edges together. While secondary product 56 could be any item desired by the consumer, or desired to be provided by the manufacturer, secondary product 56 is preferably complementary to base product 14, such as a topping for base product 14 or a promotional item.

As shown in FIG. 2, product package 10 preferably also includes a shrink band 58. Shrink band 58 surrounds and covers side periphery 18 of container 12, peripheral skirt 26, retention lip 44 and an outer portion of insert 46 above a portion of top band 36 to provide a tamper-evident seal thereabout for product package 10. Shrink band 58 also prevents pilferage of secondary product 56 since insert 46 is not easily removed.

Figure 4:
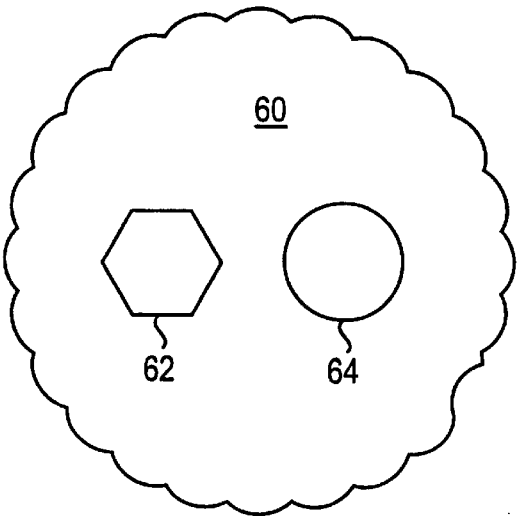
FIG. 4 is a top plan view of an alternative embodiment of an insert.

Depicted in FIG. 4 is an alternative embodiment of an insert 60. Insert 60 is similar to insert 46 and is used similarly. However, instead of a single aperture 52 covered by a transparent sheet 54 as in insert 46, insert 60 has two apertures 62 and 64 of different shapes which are not covered. With insert 60, two different secondary products could be provided beneath each aperture 62 and 64.

Figure 5:
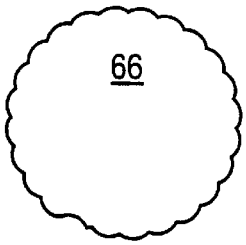
FIG. 5 is a top plan view of another alternative embodiment of an insert.

Depicted in FIG. 5 is another alternative embodiment of an insert 66. In this embodiment, insert 66 is a solid piece (i.e., without apertures) so that the secondary product provided below would not be visible. However, insert 66 does provide a greater area for labeling, etc., as desired.

In use, it will be appreciated that product package 10 is initially made by filling container 12 and by supplying a complete (with the secondary product already loaded) lid assembly 22 to close filled container 12 in one easy operation. Thus, the assembly of the various parts of lid assembly 22 can be completed separately from the filling and lidding of container 12. However, it would also be possible to apply lid 24 to filled container 12 and then to load secondary product 56 therein and to apply insert 46 thereto if desired.

It will also be appreciated that the presence of secondary product 56 in depression 40 does not reduce the random orientation stackability of lid assemblies 22 or of product packages 10 since depression 40 does not extend below lower edge 28 of skirt 26 and insert 46 does not extend above upper end 30 of skirt 26. This also means that any shipping container for a group of product packages 10 will not require size modification as the overall dimensions of each product package 10 remains the same. The presence of depression 40 also does not significantly affect the headroom of base product 14 in the top of container 12. Of course, larger secondary products 56 are possible, so long as the headroom and displacement of base product 14 are not adversely effected. In addition, it is easy to provide a new or different secondary product whenever desired.

While the present invention has been described with respect to exemplary embodiments thereof, it will be understood by those of ordinary skill in the art that variations and modifications can be effected within the scope and spirit of the invention.

What is claimed is:

1. A product package comprising:

a container in which a base product is located, said container including a top opening and a side periphery adjacent said top opening;

a lid assembly including (a) a lid which closes said top opening of said container, said lid including a peripheral skirt which engages said side periphery of said container to hold said lid in place on said container, said skirt having a lower edge and an upper end, a top extending centrally of said peripheral skirt, said top having a top band extending centrally from adjacent the upper end said peripheral skirt and a depression which extends downwards from said top band to a position above said lower edge of said skirt, and a peripheral retention lip which extends upwards an inwards from said top band, (b) a paperboard in having a peripheral border, said insert being sized such that said peripheral border is retained underneath of said peripheral retention lip so that said insert is removably-held on said lid, and (c) a secondary product which is located in said depression and which is held therein by said insert; and a tamper evident shrink band which engages said side periphery of said container, said peripheral skirt, and said retention lip for retaining said lid on said container and said insert on said lip.

2. A product package as claimed in claim 1:

wherein said periphery of said container and said peripheral skirt are conical;

wherein said insert is flat;

wherein said retention lip is an inwardly angled circular ring;

wherein said top band is circular and has an inner flat portion; and wherein said depression is centrally located relative to said peripheral skirt.

3. A product package as claimed in claim 1:

wherein said base product is a food item; and wherein said secondary product is complementary to said food item.

4. A product package as claimed in claim 1:

wherein said lid is a molded plastics material;

wherein said peripheral skirt includes an interior groove thereabout; and wherein said side periphery of said container includes an upper exterior ledge thereabout which is retained in said groove of said peripheral skirt when said lid is positioned to close the top opening of said container.

5. A product package as claimed in claim 1:

wherein said insert includes an aperture located over said depression; and further including a transparent sheet attached to said insert which covers said aperture and hence which allows said secondary product in said depression to be viewed therethrough.

6. A product package as claimed in claim 1:

wherein said insert includes an aperture located over said depression through which said secondary product is viewable.

7. A product package as claimed in claim 1:

wherein said insert is made of paperboard and has a wavy edge;

wherein said lid is a molded plastics material;

wherein said peripheral skirt includes an interior groove thereabout; and wherein said side periphery of said container includes an upper exterior ledge thereabout which is retained in said groove of said peripheral skirt when said lid is positioned to close the top opening of said container.

8. A product package as claimed in claim 7:

wherein said side periphery of said container and said peripheral skirt and conical;

wherein said insert is flat;

wherein said retention lip is an inwardly angled circular ring;

wherein said top band is circular and has an inner flat portion; and wherein said depression is centrally located relative to said peripheral skirt.

9. A product package as claimed in claim 8:

wherein said insert includes an aperture located over said depression; and further including a transparent sheet attached to said insert which covers said aperture and hence which allows said secondary product in said depression to be viewed therethrough.

* * * * *